US008534953B2

(12) United States Patent
Gantner et al.

(10) Patent No.: US 8,534,953 B2
(45) Date of Patent: Sep. 17, 2013

(54) ROADWAY STRUCTURE HAVING IMPROVED ADHESIVE PROPERTIES

(75) Inventors: Hans Gantner, Nenzing (AT); Raphael Teysseire, Visp (CH); Herbert Ackermann, Tann (CH)

(73) Assignee: Sika Technology AG, Baar (CH)

( * ) Notice: Subject to any disclaimer, the term of this patent is extended or adjusted under 35 U.S.C. 154(b) by 0 days.

(21) Appl. No.: 13/346,003

(22) Filed: Jan. 9, 2012

(65) Prior Publication Data

US 2012/0170977 A1 Jul. 5, 2012

Related U.S. Application Data

(63) Continuation of application No. PCT/EP2010/059682, filed on Jul. 7, 2010.

(30) Foreign Application Priority Data

Jul. 7, 2009 (EP) ..... 09164780

(51) Int. Cl.
*E01C 3/00* (2006.01)

(52) U.S. Cl.
USPC ..... 404/28; 404/31; 404/75; 52/746.1

(58) Field of Classification Search
USPC ..... 404/28, 31, 75; 52/746.1; 427/136
See application file for complete search history.

(56) References Cited

U.S. PATENT DOCUMENTS

| | | | | |
|---|---|---|---|---|
| 1,955,421 | A * | 4/1934 | Hayden | 404/28 |
| 3,909,144 | A * | 9/1975 | Garn et al. | 404/31 |
| 4,319,854 | A * | 3/1982 | Marzocchi | 404/28 |
| 4,556,338 | A * | 12/1985 | Fahey | 404/28 |
| 4,909,662 | A * | 3/1990 | Baker | 404/31 |
| 7,232,276 | B2 * | 6/2007 | Oka et al. | 404/31 |
| 8,186,117 | B2 * | 5/2012 | Eren | 52/408 |
| 2011/0250012 | A1 * | 10/2011 | Paschkowski et al. | 404/27 |

FOREIGN PATENT DOCUMENTS

| | | | |
|---|---|---|---|
| AT | 413990 | B | 8/2006 |
| DE | 2539333 | A1 | 3/1977 |
| EP | 0199371 | A2 | 10/1986 |
| EP | 0212429 | A2 | 3/1987 |
| WO | WO 2008/095215 | A1 | 8/2008 |

OTHER PUBLICATIONS

International Search Report (PCT/ISA/210) issued on Dec. 7, 2010, by European Patent Office as the International Searching Authority for International Application No. PCT/EP2010/059682.

Written Opinion (PCT/ISA/237) issued on Dec. 7, 2010, by European Patent Office as the International Searching Authority for International Application No. PCT/EP2010/059682.

* cited by examiner

*Primary Examiner* — Gary Hartmann
(74) *Attorney, Agent, or Firm* — Buchanan Ingersoll & Rooney PC

(57) ABSTRACT

A method for the production of a roadway structure, the method including: (i) applying a primer to a support structure; (ii) applying a plastic membrane to the support structure that is primed according to step (i); and then (iii) applying an adhesive composition that includes a) at least one solid epoxide resin, and b) at least one thermoplastic polymer that is solid at room temperature, and (iv) applying a bitumen-based support layer.

21 Claims, 3 Drawing Sheets

ROADWAY STRUCTURE HAVING IMPROVED ADHESIVE PROPERTIES

RELATED APPLICATION(S)

This application claims priority as a continuation application under 35 U.S.C. §120 to PCT/EP2010/059682, which was filed as an International Application on Jul. 7, 2010 designating the U.S., and which claims priority to European Application No. 09164780.0 filed in Europe on Jul. 7, 2009. The entire contents of these applications are hereby incorporated by reference in their entireties.

FIELD

The disclosure relates to the field of sealing roadways on a support structure.

BACKGROUND INFORMATION

Roadways, which are applied on a support structure, for example, on a concrete support structure, are frequently encountered, for example, as bridges. Such concrete support structures can be sealed by bitumen webs. Because of their thermoplastic behavior, however, bitumen webs can be susceptible to temperature fluctuations. Elastic plastic webs, however, have an elastic behavior that is constant over a broad temperature range and thus perform their function as a seal even under extreme temperature conditions. As the uppermost layer, a bitumen-based support layer can be used in road construction. In this connection, the problem is that a good adhesive bond between the support layer and the material of the support structure, for example, concrete, has to be present, which, of course, applies to the adhesion of all intermediate layers. In this connection, for example, the adhesion between the plastic membrane and the bituminous support layer represents a very difficult problem to solve because of the materials involved.

One starting point for solving this problem lies in the use of melted asphalt as an adhesive between the plastic layer and the bituminous support layer. These systems have, however, the disadvantage that first the melted asphalt has to be applied at a higher temperature, and the bituminous support layer can be applied only after cooling, which, on the one hand, lengthens and increases the cost of the construction of the sealing and/or construction process of the roadway because of this additional step. On the other hand, it has been shown that because of the high axle loads of the motor vehicles used on the roadway, such roadways become deformed and within short periods of time cause accidental damage to the coating of the roadway.

WO 2008/095215 discloses the use of a concrete roadway. It discloses a concrete roadway on a concrete support structure with an intervening plastic membrane as well as an adhesive layer between the plastic membrane and the concrete roadway. To ensure the adhesion of the concrete roadway to the adhesive layer, in this connection the scattering of silica sand into the adhesive layer before its hardening is proposed.

To improve the bond between the plastic membrane and the bituminous support layer, AT 413 990 B proposes the use of a polyurethane-based adhesive primer, onto which a loose granulate of synthetic resin is scattered. On the one hand, the scattering of granulate is associated with several problems. During or after the scattering of granulate, for example, onto concrete support structures that are exposed to wind, it can cause, for example, large amounts of granulate to be swept away by the wind, which results in accidental material losses or in uncontrolled adhesive losses. Moreover, it has been shown that such systems under shear stress have a strong tendency toward an adhesive rupture between granulate and asphalt. The occurrence of an adhesive rupture is an indication of deficient adhesion and can lead to delamination or to leaks, for example, after extended exposure to the environment.

SUMMARY

According to an exemplary aspect, a method for the production of a roadway structure is provided, the method comprising: (i) applying a primer to a support structure; (ii) applying a plastic membrane to the support structure that is primed according to step (i); and then (iii) applying an adhesive composition that includes a) at least one solid epoxide resin, and b) at least one thermoplastic polymer that is solid at room temperature, and (iv) applying a bitumen-based support layer.

According to an exemplary aspect, a method of increasing adhesion of bitumen to plastic in a roadway structure is provided, the method comprising: applying an adhesive composition that includes a) at least one solid epoxide resin, and b) at least one thermoplastic polymer that is solid at room temperature, and applying a bitumen-based support layer directly to the applied adhesive composition.

According to an exemplary aspect, a roadway structure is provided, comprising: a support structure, whose surface is coated with a primer, on which a plastic membrane is applied, a bitumen-based support layer, and (i) an adhesive layer located between the plastic membrane and the bitumen-based support layer, wherein the adhesive layer is formed from at least one solid epoxide resin and at least one thermoplastic polymer that is solid at room temperature; or (ii) a modified area of the plastic membrane and/or the bitumen-based support layer in an interface area between the plastic membrane and the bitumen-based support layer, wherein the modified area is modified with at least one solid epoxide resin and at least one thermoplastic polymer that is solid at room temperature; or (i) and (ii).

BRIEF DESCRIPTION OF THE DRAWINGS

Below, embodiments of the disclosure are explained in more detail based on the drawings. The same elements are provided with the same reference numbers in the various figures. Movements are indicated with arrows.

DETAILED DESCRIPTION

Figure 1:
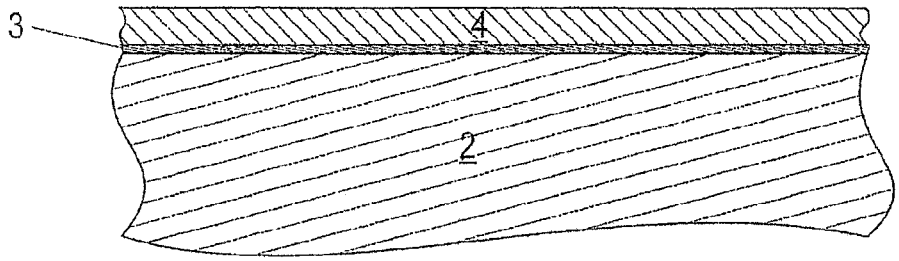
FIG. 1 shows a cross-section through a support structure with applied primer and plastic membrane (situation during or after step (ii)), according to an exemplary embodiment.

Disclosed is an exemplary roadway structure that can be constructed simply and efficiently and that results in a high degree of adhesion between the plastic membrane and the bituminous support layer to form a good adhesive bond, and in the adhesion test under shear stress, it results in a high proportion of cohesive rupture in asphalt.

Disclosed is a roadway structure which can have an advantageous endurance even under high axle loads of motor vehicles. In a fast and cost-effective way, this method allows a roadway to be sealed on a support structure, for example, on a concrete support structure.

According to an exemplary aspect, disclosed is the combination of a solid epoxide resin and a thermoplastic polymer that is solid at room temperature as exemplary components of the adhesive composition.

In addition, it was shown that a problem of the state of the art, namely the undesired sweeping away of adhesives by the wind, can be mitigated or prevented with the exemplary embodiments, and thus the quality control can be simply increased when constructing a roadway structure.

This disclosure can make it possible to greatly increase the proportion of the cohesive rupture in the asphalt. For example, for the shear strength, the critical point can be the internal strength of the asphalt and no longer the adhesion. It can also be ensured that the adhesive bond remains intact even over the longer term, and the formation of delamination of the bitumen-based support layer and thus the formation of cracks and leaks can be greatly reduced.

For example, the use of melted asphalt can be eliminated.

In a first exemplary aspect, this disclosure relates to a method for the production of a roadway structure that comprises the steps (i) application of a primer to a support structure, for example, application of a concrete primer to a concrete structure;

(ii) application of a plastic membrane to the support structure that is primed according to step (i);

and then (iii) application of an adhesive composition that contains a) at least one solid epoxide resin b) at least one thermoplastic polymer that is solid at room temperature and (iv) application of a bitumen-based support layer.

Such a support structure can be a structure above or below ground level. For example, this can be a bridge, a gallery, a tunnel, an on-ramp or off-ramp, or a parking deck. A bridge is one example of such a support structure. This support structure that is used for the roadway is a structure that includes a material that can have a supporting function. For example, this material is a metal or a metal alloy or a concrete, for example, a reinforced concrete, for example, a steel concrete.

A bridge made of concrete is an example of such a support structure.

In step (i), a primer, for example, a concrete primer, is applied to the support structure. In this document, in general a "primer" is defined as a thin layer of a polymer that is applied on a substrate, which improves the adhesion between this substrate and another substrate. At room temperature, a primer has a free-flowing consistency and is applied to the substrate by spreading, painting, rolling, spraying, pouring or brushing. In this connection, the term "free-flowing" refers not only to liquid material but also to more highly viscous, honey-like to pasty materials, whose form is adapted under the action of gravitational force.

In this document, "room temperature" is defined as a temperature of 23° C.

In this document, "concrete primer" is defined as a thin layer of a polymer that is applied to the concrete, and said polymer improves the adhesion of concrete to another substrate. For example, primers based on epoxide resin are concrete primers. For example, these are two-component hard epoxide resin primers, of which one (i.e., the first) component contains an epoxide resin, for example, an epoxide resin based on bisphenol-A-diglycidyl ether, and the other (i.e., the second) component contains a hardener, for example, a polyamine or a polymercaptan. Epoxide resin primers, which do not have any fillers, are exemplary. In addition, the concrete primers can be advantageously thin, for example, with a viscosity of below 10,000 mPa, for example, between 10 and 1,000 mPa, so that they can penetrate the concrete surface. Two-component, thin epoxide resin primers, as they are marketed under the trade series names Sikafloor® or Sikagard® of Sika Deutschland GmbH, or Sika Schweiz AG, can be employed as concrete primers. As concrete primers, Sikafloor®-156 base coat and Sikagard®-186 can be employed.

For other materials, in each case, there are suitable primers, for example, steel primers for steel, such as those known to one skilled in the art.

In this document, "plastic primer" is defined as a thin layer of a polymer that is applied on the plastic membrane and that improves the adhesion of plastic membrane to another substrate. For example, epoxide-resin-based primers are plastic primers.

In addition, in an exemplary embodiment, inorganic grit, for example, sand, for example, silica sand, can be scattered between step (i) and step (ii) into the primer, for example, into the concrete primer. To ensure a good bond between the grit and the primer, for example, concrete primer, the grit can be scattered before the primer hardens.

The inorganic grit can have a maximum grain size of less than 1 mm, for example, between 0.1 and 1 mm, and for example, between 0.3 and 0.8 mm.

The amount of such grit can be measured in such a way that the primer does not cover the entire surface, but in the structure, points can be present where the primer is in direct contact with the plastic membrane.

It was found that the use of grit can be advantageous for the bond between the plastic membrane and the primer, or the support structure. Possible explanations for this that do not, however, limit the disclosure are that the primer at least partially flows around the grain surface and thus a larger contact surface is provided between the plastic membrane and the primer, and/or that the primer layer is locally greatly reinforced by the inorganic grit, so that greater forces can be transmitted or absorbed between the plastic membrane and the support structure and/or that a purely mechanical anchoring between the plastic membrane and the primer is carried out by the grit, by the grains bound in the matrix of the primer resulting in a roughened primer surface, and by these grains being embedded in the surface of the exemplary elastic plastic membrane. In the case of a plastic membrane that is produced on the spot, for example, by a spraying method, the plastic membrane obtains a considerably larger contact surface since it is applied to a primer surface, which has a considerably larger surface because of the roughening caused by the grit.

Relative to the layer thickness of the primer, the latter is also greatly dependent on the surface roughness of the support structure whether grit is used or not. The mean layer thickness of the primer can be between 100 micrometers and 10 millimeters; for example, the mean layer thickness of the primer layer is below 3 mm, for example, between 0.3 and 2 mm.

Then, in step (ii), a plastic membrane is applied on the support structure that is primed according to step (i).

To be as suitable as possible as plastic membrane, the plastic membrane can be as water-tight as possible and not be destroyed or mechanically damaged even under the extended action of water or moisture. As plastic membranes, for example, such membranes are suitable as are already used in the state of the art for sealing purposes, for example, for the roof structure or for bridge sealing purposes. To have it damaged or changed as little as possible under the action of temperature by the application of a bitumen-based support layer, the plastic membranes can be manufactured from a material with a softening temperature of above 140° C., for example, between 160° C. and 300° C. The plastic membrane can have an at least small extent of elasticity, for example can span expansion differences caused by temperatures between the asphalt and support structure or stresses caused by cracks in the support structure or the support layer, without the plastic membrane being damaged or detached and the sealing function of the plastic membrane being impaired. Exemplary are plastic membranes that are based on polyurethanes or polyureas or poly(meth)acrylates or epoxide resins. The plastic membrane can be used as a premanufactured web. In this case, the plastic membrane can be manufactured by an industrial process in a membrane plant and is used on the construction site, for example, in the form of plastic membrane starting from a roll. In this case, the plastic membrane can be brought into contact in the primer before its complete curing or hardening.

The plastic membrane can also be produced on the spot, for example by a cross-linking reaction of reactive components, which are mixed and applied on the spot. Sprayed plastic membranes can be employed.

The plastic membrane can have a layer thickness in the millimeter range, for example, between 0.5 and 15 mm, and for example, between 1 and 4 mm.

Examples of plastic membranes are polyurethane membranes, for example, sprayed membranes that include two-component polyurethanes.

A plastic primer can be applied on the plastic membrane applied in step (ii) before the adhesive composition in step (iii) is applied in a step (iia). As plastic primers, for example, primers made of two-component polyurethanes or epoxides, for example, epoxides, are used.

Use of an exemplary aspect can ensure the bond between the plastic membrane and the support layer based on bitumen by means of the application of a specific adhesive composition.

An exemplary adhesive composition includes a) at least one solid epoxide resin as well as b) at least one thermoplastic polymer that is solid at room temperature.

In the best case, the term "solid epoxide resin" is known to one skilled in epoxides and is used in contrast to "liquid epoxide resins." The glass temperature of solid resins is above room temperature, i.e., they can be crushed into free-flowing powders at room temperature.

Exemplary solid epoxide resins have the formula (I)

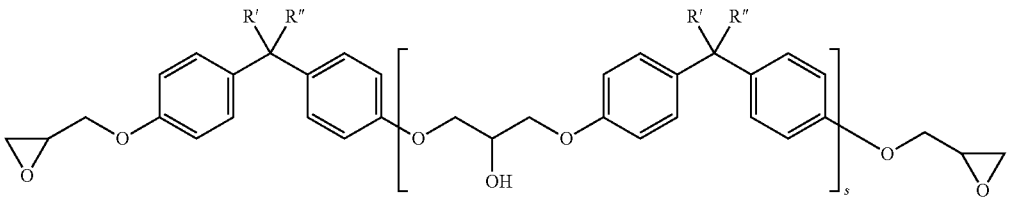

(I)

In this connection, the substituents R' and R", independently of one another, either stand for H or $CH_3$. In addition, the index s stands for a value of >1.5, for example, of 2 to 12.

Such solid epoxide resins are commercially available, for example, under the tradenames D.E.R.™ or Araldite® or Epikote from Dow or Huntsman or Hexion.

Compounds of Formula (I) with an index s of between 1 and 1.5 are referred to as semi-solid epoxide resins. In an exemplary embodiment, they can also be considered to be solid resins. However, epoxide resins can be exemplary, for example, where the index s has a value of >1.5.

For example, if instead of the solid epoxide resin, a liquid epoxide resin is used, advantages described above do not occur. In an exemplary embodiment, a solid epoxide resin is present in the adhesive composition.

The thermoplastic polymer that is solid at room temperature is a polymer material at room temperature, which softens at a temperature of above one of the softening temperatures and finally becomes free-flowing.

In this document, softening temperatures or softening points are defined, for example, according to the Ring & Ball Method in accordance with DIN ISO 4625.

It can be advantageous when the thermoplastic polymer that is solid at room temperature has a softening point in the range of 80° C. to 150° C., for example, of 90° C. to 130° C. Exemplary are thermoplastic polymers, which have a softening point that is at least 25° C. below the temperature of the bitumen-based support layer that is measured during application in step (iv).

Defined as thermoplastic polymers that are solid at room temperature are, for example, homopolymers or copolymers of at least one olefinically unsaturated monomer, for example, monomers that are selected from the group that consists of ethylene, propylene, butylene, butadiene, isoprene, acrylonitrile, vinyl ester, for example, vinyl acetate, vinyl ether, allyl ether, (meth)acrylic acid, (meth)acrylic acid ester, maleic acid, maleic acid anhydride, maleic acid ester, fumaric acid, fumaric acid ester and styrene.

Examples include copolymers, which are produced only from the monomers of the above-cited group.

In addition, copolymers, modified by grafting reactions, of olefinically unsaturated monomers, for example, the copolymers of the preceding section that are modified by grafting reactions, can be employed.

As thermoplasts that are solid at room temperature, there are, for example, polyolefins, for example, poly-α-olefins. Polyolefins that are exemplary are atactic poly-α-olefins (APAO).

As thermoplastic polymers that are exemplary, there are ethylene/vinyl acetate copolymers (EVA), for example, those with a vinyl acetate proportion of below 50% by weight, for example, with a vinyl acetate proportion of between 10 and 40% by weight, for example, between 20 and 35% by weight, and in most cases, for example, between 27 and 32% by weight.

At least two different thermoplastic polymers that are solid at room temperature can be used, which can a different chemical composition from each other. For example, an ethylene/vinyl acetate copolymer is one of these two different thermoplastic polymers.

In addition, it can be advantageous if the additional thermoplastic polymer is a copolymer, in whose production maleic acid or maleic acid anhydride was used as a monomer or as a grafting reagent.

The weight ratio of solid epoxide resin to thermoplastic polymer that is solid at room temperature can be between 1:2 and 1:10, for example, between 1:4 and 1:8.

In addition, the adhesive composition can have a tackifying agent resin (tackifier resin), for example, based on hydrocarbon resins, for example, aliphatic hydrocarbon resins, for example, as they are marketed by, for example, the Exxon Mobil Company under the trade name Escorez™.

The adhesive composition can contain a chemical or physical blowing agent.

In this connection, there can be exothermic propellants, such as, for example, azo compounds, hydrazine derivatives, semicarbazides or tetrazoles. Exemplary are azodicarbonamide and oxy-bis (benzenesulfonyl-hydrazide), which release energy during decomposition. In addition, endothermic propellants are also suitable, such as, for example, sodium bicarbonate/citric acid mixtures. Such chemical propellants are available, for example, under the name Celogen™ of the Chemtura Company. Also suitable are physical propellants such as that available under the trade name Expancel™ of the Akzo Nobel Company.

Exemplary propellants are those that are available under the trade name Expancel™ of the Akzo Nobel Company or Celogen™ of the Chemtura Company.

Exemplary propellants are chemical propellants, which release a gas during heating, for example, to a temperature of 100 to 160° C.

The amount of physical or chemical propellant can be, for example, in a range of 0.1-3% by weight relative to the weight of the adhesive composition.

In addition, the adhesive composition can contain, for example, epoxide cross-linking catalysts and/or hardeners for epoxide resins, which is activated by elevated temperature. For example, the latter are selected from the group that consists of dicyanodiamide, guanamines, guanidines, aminoguanidines and derivatives thereof; substituted ureas, for example, 3-(3-chloro-4-methylphenyl)-1,1-dimethylurea (chlorotolurone), or phenyl-dimethylureas, for example, p-chlorophenyl-N,N-dimethylurea (monurone), 3-phenyl-1,1-dimethylurea (fenurone), 3,4-dichlorophenyl-N,N-dimethylurea (diurone), N,N-dimethylurea, N-iso-butyl-N',N'-dimethylurea, 1,1'-(hexane-1,6-diyl)bis(3,3'-dimethylurea) as well as imidazoles, imidazole salts, imidazolines and amine complexes. These heat-activatable hardeners can be activated at a temperature of 80-160° C., for example, 85° C. to 150° C., and, for example, 90-140° C. For example, dicyanodiamide is used in combination with a substituted urea.

The adhesive composition can also contain still further components in addition to the already mentioned components, for example pesticides, stabilizers, for example, heat stabilizers, softeners, pigments, adhesion promoters, for example, organosilanes, reactive binders, solvents, rheology modifiers, fillers or fibers, for example, glass fibers, carbon fibers, cellulose fibers, cottonseed fibers, or synthetic plastic fibers, for example, fibers that include polyester or of a homo- or copolymer of ethylene and/or propylene or of viscose. Depending on the configuration of the adhesive composition, the fibers can be used as short fibers or long fibers, or in the form of spun, woven, or unwoven fiber materials. The use of fibers can improve the mechanical reinforcement, for example, when at least a portion of the fibers include tenacious or highly tenacious fibers, for example, that include glass, carbon or aramides.

The adhesive composition can be used in the form of a granulate, for example, with a granulate diameter of 1 to 10 mm, for example, 3 to 6 mm.

In an exemplary embodiment, the adhesive composition can be used in combination with a plastic membrane that is produced on the spot, as previously described, and this plastic membrane that is produced, for example, by a cross-linking reaction of reactive components is applied within the open time. The application of the adhesive composition can be carried out by a scattering into the plastic membrane that has not yet reacted and is at least slightly sticky. This can have the advantage that the scattered adhesive composition adheres to the surface of the plastic membrane, and an accidental removal of the adhesive composition, for example by wind, can be prevented to a large extent.

In another exemplary embodiment, in step (ii a), a plastic primer is applied to the plastic membrane that is applied in step (ii), in which the adhesive composition is applied within the open time of the plastic primer. The application of the adhesive composition is carried out, for example, by a scattering into the plastic primer that has not yet reacted and is at least slightly sticky. This can have the advantage that the scattered adhesive composition adheres to the surface of the adhesive primer that adheres to the plastic membrane, and an accidental removal of the adhesive composition, for example by wind, can be prevented to a large extent.

In another exemplary embodiment, the adhesive composition is used in the form of a membrane. This is carried out in the form of applying the adhesive composition in the form of a thin membrane. Such an adhesive composition membrane can be produced, for example, in a membrane plant by an at least partial melting of the adhesive composition and subsequent extrusion or calendaring. In any case, it can also be advantageous if the adhesive composition membrane contains a fiber fabric or fiber non-woven fabric or is bonded, e.g., extruded, to a fiber fabric or fiber non-woven fabric. After cooling, this membrane is simply rolled and thus simply stored, or transported. The adhesive composition thus moves along simply to the construction site and can be rolled off there and be cut to the desired dimensions. This is a very cost-effective and time-efficient operating step. In principle, the surface of such an adhesive composition membrane is tack-free. Nevertheless, it can be advantageous, however, to protect the surface of the adhesive composition membrane with a separating paper, for example a siliconized paper, to be able to eliminate the possible risk that during the storage time, the individual layers of one roll bond together. The use of an adhesive composition membrane can have the advantage that the adhesive composition is dispersed extensively and homogeneously and that the accidental removal of the adhesive composition, for example by wind, can be prevented to a large extent. Under certain circumstances, it can also be helpful if an adhesive (pressure-sensitive adhesive) is applied to one surface of such an adhesive composition membrane to achieve a better attachment of the adhesive composition membrane to the plastic membrane during the production of the roadway structure. In this case, the use of a separating paper can be used to prevent an accidental bonding of the individual layers below one another, for example, if they are rolled.

In another exemplary embodiment, the adhesive composition in the molten state is applied to the plastic membrane that is applied in step (ii). This can be carried out by the adhesive composition being melted on the spot by means of a warming device and sprayed on or strewn in, for example, the molten state. By the cooling, the adhesive composition becomes hardened to form a thin membrane that adheres to the plastic membrane.

In an exemplary embodiment, the adhesive composition represents a dispersion, in which at least solid epoxide resin and thermoplastic polymer are present as a solid phase in a liquid phase. In this case, the adhesive composition in step (iii) is applied directly to the plastic membrane. The liquid phase is formed, for example, by a liquid reactive binder, for example, a binder based on two-component epoxides, which in any case still have solvents or softeners. At the end of the open time of this dispersion, a membrane is formed, which binds the solid parts of the dispersion. This can have the advantage that these solid portions of the adhesive composition adhere on the surface on the plastic membrane, and an accidental removal of the adhesive composition, for example by wind, can be prevented to a large extent.

Finally, a bitumen-based support layer is applied in step (iv).

It can be advantageous when this bitumen-based support layer is applied directly to the adhesive composition.

The support layer can represent the roadway that is in direct contact with motor vehicles. The bituminous support layer is heated before the application to a temperature of, for example, 140° C. to 160° C. and for example, rolled by means of rollers. Known techniques for application of the bituminous support layer can be employed. In addition to bitumen, the support layer can have the additional possible components that are known to one skilled in the art. Known types and amounts of the components of bitumen-based compositions, which are used for the construction of roadways, can be employed. In this connection, the support layers can have mineral fillers, for example, sand or crushed stones, to a significant extent.

For example, the basic difficulty of ensuring a good adhesive bond between the plastic membrane and the support layer can be attributed to this mixture that consists of mineral components and bitumen and can be explained as a result of their greatly different hydrophilia, or hydrophobia, and the associated different wetting properties.

When the molten bitumen makes contact with the adhesive composition, the thermoplastic polymer, which is solid at room temperature, and, in any case, other meltable components of the adhesive composition melt in or on, depending on their melting points. If they melt on, they can form a largely homogeneous thermoplastic layer, or they can also dissolve near the surface in the bitumen and form a thermoplastic-containing boundary-phase layer. Thus, the adhesive composition does not absolutely have to form a discrete and individual layer. If the adhesive composition has a chemical or physical propellant, the propellant is activated during the molten bitumen's contact with the adhesive composition, and for example, a gas is released. It was shown that the adhesive improvement in this connection is further enhanced by the proportion of cohesive rupture being as was observed during testing. The basis for this adhesive improvement is not completely explained. It is assumed that the generation of gas modifies the bitumen structure at the interface, thereby achieving, for example, a better mechanical gripping of the bitumen and adhesive composition.

At an elevated temperature, the solid epoxide resin can be cross-linked by itself but primarily under the action of the cross-linking epoxide catalysts and/or hardeners for epoxide resins, which are activated by elevated temperature, and/or compounds having anhydride groups. This can be one of the reasons for the increase in adhesion. For example, advantageous properties are not achieved in the absence of the thermoplastic polymer that is solid at room temperature.

The thus produced roadway structure can have the advantage that a prolonged bond under the individual layers below one another is ensured and that it also is dimensionally stable under large axle loads. Moreover, the bond between the plastic membrane and the bitumen has been substantially improved relative to the state of the art. Thus, fatigue cracks that could impair the sealing function of the roadway structure develop considerably less quickly. This method that is presented here thus offers not only a saving of time during the production of the roadway structure, but brings with it further savings during maintenance, since the repair or replacement intervals can be considerably extended.

Another exemplary aspect of this disclosure relates to the use of the adhesive composition previously described in detail for increasing the adhesion of bitumen to plastic.

In another exemplary aspect, this disclosure relates to a roadway structure that has a support structure, for example, a concrete support structure, whose surface is coated with a primer, for example, with a concrete primer, to which a plastic membrane is applied, as well as a bitumen-based support layer, and either an adhesive layer that is located between a plastic membrane and support layer; or a modified area of the plastic membrane and/or support layer in the interface area between the plastic membrane and the support layer.

In this connection, the adhesive layer is designed on the basis of, for example, is formed from, at least one solid epoxide resin and at least one thermoplastic polymer that is solid at room temperature.

The modified area of the plastic membrane and/or support layer in the interface area between the plastic membrane and support layer in this connection is modified with at least one solid epoxide resin and at least one thermoplastic polymer that is solid at room temperature.

Details regarding the individual layers and materials were already previously discussed during the method for the production of the roadway structure.

As discussed above, in production, either a discrete intermediate layer of the adhesive composition is created and forms the adhesive layer or the plastic membrane and/or the support layer is/are modified by the adhesive composition, in such a way that the composition of the area of the plastic membrane and/or the support layer near the interface differs chemically from the composition of the area of the plastic membrane and/or the support layer away from the interface. The thickness of the area to be modified is dependent on the ability of the components that are contained in the adhesive composition to migrate and the temperature of the bitumen in the application as well as its cooling behavior. The ability to migrate is also dependent on, for example, molecular weight and the polarity of these components. Usually, the boundary of this modified area is not formed sharply, but rather gradually.

FIG. 1 shows a diagrammatic cross-section through a concrete support structure 2 with applied concrete primer 3 and plastic membrane 4. For this purpose, in a first step (i), a two-component hard epoxide resin-concrete primer 3 was applied on the concrete support structure 2. Then, before the hardening, a silica sand (not shown in FIG. 1) with the grain size 0.4 mm was scattered into the primer. Then, in step (ii), a two-component polyurethane-plastic membrane 4 was sprayed in a layer thickness of 4 mm. FIG. 1 shows the situation of the roadway structure according to step (ii).

Figure 2:
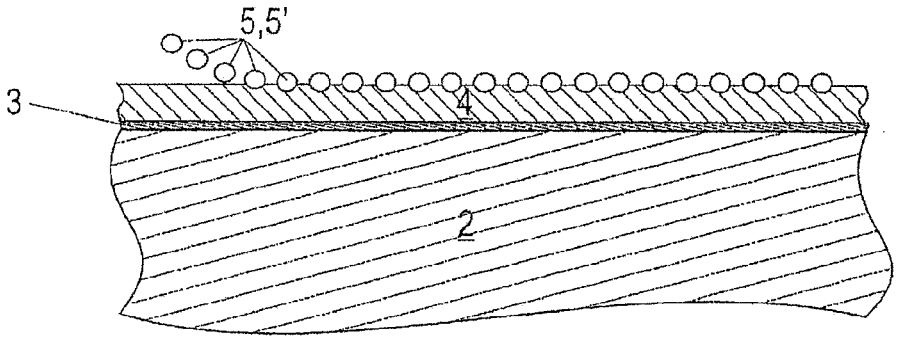
FIG. 2 shows a cross-section through a support structure with applied primer and applied adhesive composition (situation according to step (iii)), according to a first exemplary embodiment.

FIG. 2 shows an exemplary embodiment of the application of the adhesive composition 5. In this case, the plastic membrane 4 was produced on the spot, for example, as a sprayable 2-component polyurethane membrane. The adhesive composition 5 is scattered as a form of a granulate 5' on the surface of the plastic membrane 5 within, and, for example, toward the end, of the open time of said plastic membrane 5. Since the plastic membrane is still not completely reacted, the granulates 5' adhere to the surface of the still sticky plastic membrane or sink slightly into the plastic membrane and are thus bonded and bound to the plastic membrane surface during the reaction of the plastic membrane.

Figure 3:
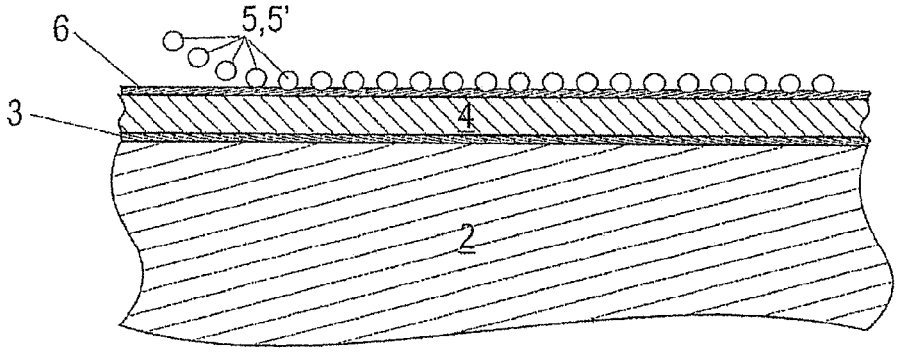
FIG. 3 shows a cross-section through a support structure with applied primer and applied adhesive composition (situation according to step (iii)), according to a second exemplary embodiment.

FIG. 3 shows another exemplary embodiment of the application of the adhesive composition 5. In this case, a plastic primer 6 is applied to the plastic membrane 4. The plastic primer in this case can have a reactive binder, so that a cross-linking reaction occurs by a chemical reaction. The adhesive composition 5 is scattered as a form of a granulate 5' on the surface of the plastic primer 6 within, and, for example, toward the end, of the open time of said plastic primer 6. Since the plastic primer is still not completely reacted, the granulates 5' adhere to the surface of the still sticky plastic primer or sink slightly into the plastic primer and are thus bonded and bound to the plastic primer surface during the reaction of the plastic primer.

Figure 4:
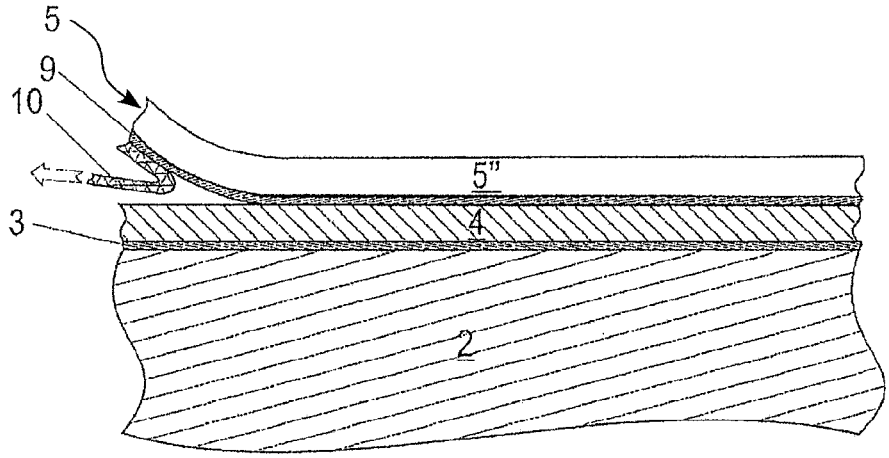
FIG. 4 shows a cross-section through a support structure with applied primer and applied adhesive composition (situation according to step (iii)), according to a third exemplary embodiment.

FIG. 4 shows another exemplary embodiment of the application of the adhesive composition 5. In this case, the adhesive composition is applied in the form of a membrane 5". The membrane was produced by melting and extrusion of the adhesive composition in a membrane plant. On one side of the membrane 5", a pressure-sensitive adhesive 9 was then applied there and covered with a separating membrane 10 and then rolled up. Such a roller is now brought to the construction site, if necessary, and the membrane is unrolled and cut into the correct length and width, and applied on the plastic membrane 4. During this laying, the separating membrane 10 is now peeled off. In FIG. 4, the peel-off direction is indicated by a gray arrow. By removing the membrane, the pressure-sensitive adhesive 9 comes into contact with the plastic membrane 4, by which the membrane 5" is at least temporarily attached to the plastic membrane 4, and, to a very large extent, the accidental removal of adhesive composition 5 is prevented even in the event of high winds.

Figure 5:
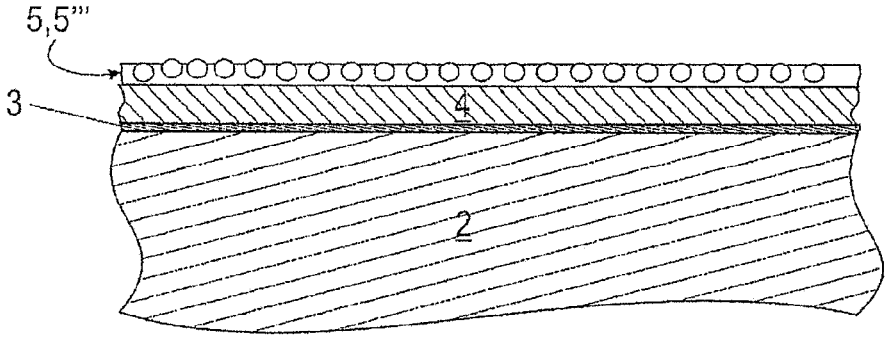
FIG. 5 shows a cross-section through a support structure with applied primer and applied adhesive composition (situation according to step (iii)), according to a fourth exemplary embodiment.

FIG. 5 shows another exemplary embodiment of the application of the adhesive composition 5. In this case, the adhesive composition 5 is applied in the form of a dispersion 5'''. The dispersion 5''' has solid phases that include solid epoxide resin and thermoplastic polymer, and a continuous liquid phase, which is formed by a liquid binder based on two-component epoxides and solvents or softeners. The dispersion 5''' is applied, for example, by means of a paintbrush homogeneously on the surface of the plastic membrane 4. Owing to the hardening reaction of the liquid binder, this liquid phase becomes solidified and binds the solid phase, in such a way that the adhesive composition 5 is attached to the surface of the plastic membrane 4.

Figure 6:
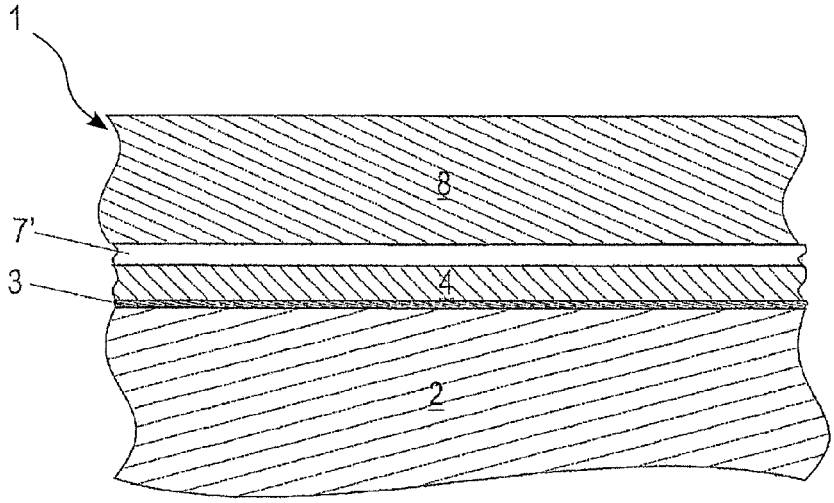
FIG. 6 shows a cross-section through a roadway structure with an adhesive layer, according to an exemplary embodiment.

FIG. 6 shows a diagrammatic cross-section through an exemplary embodiment of a roadway structure 1. In the intermediate stage of the roadway structure, as it was described in, for example, FIG. 2, a bitumen-based support layer 8 was applied after this in step (iv). The adhesive compositions 5, for example, in the form of scattered granulates 5', have been heated by the contact with the molten bitumen and are melted in such a way that an adhesive layer 7' forms. For the sake of simplicity, the adhesive composition 5 was shown as a full-surface layer in the depiction shown here. After the applied bitumen layer is cooled, the support layer 8 is connected to the plastic membrane 4 in a stable and tight manner.

Figure 7:
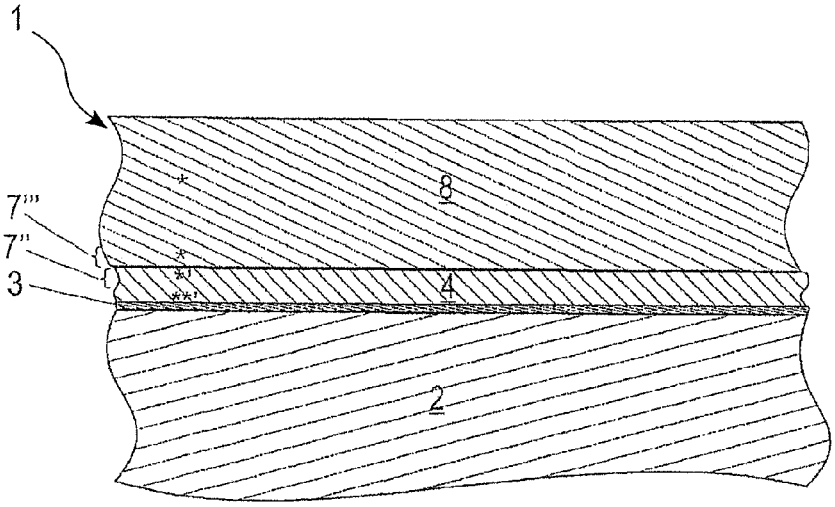
FIG. 7 shows a cross-section through a roadway structure with a modified area of the support layer and the plastic membrane, according to an exemplary embodiment.

FIG. 7 shows a diagrammatic cross-section through another exemplary embodiment of a roadway structure 1. In the intermediate stage of the roadway structure, as it was described in, for example, FIG. 2, a bitumen-based support layer 8 was applied after this in step (iv). The adhesive compositions 5, for example, in the form of scattered granulate 5', were heated by the contact with the molten bitumen and are molten. As shown here, the adhesive composition 5 penetrates both the plastic membrane 4 and the support layer 8. In the interface area between the plastic membrane 4 and the support layer 8, one modified area each thus forms in the area near the interface, namely a modified area 7" in the plastic membrane 4 or a modified area 7''' in the support layer 8. Owing to the penetration of the adhesive composition 5 into the plastic membrane 4 or support layer 8, the chemical composition at the sites, diagrammatically indicated by * or *' in FIG. 7, near the plastic membrane/support layer interface, is different from the composition of the plastic membrane 4 or support layer 8 at a site, diagrammatically indicated by  or ' in FIG. 7, away from the plastic membrane/support layer interface. After the applied bitumen layer is cooled, the support layer 8 is connected to the plastic membrane 4 in a stable and tight manner.

EXAMPLES

The compositions were produced according to the parts by weight in Table 1, in which the components were mixed together in a twin-screw extruder at a temperature of 80° C. A granulate with a granulate diameter of 1 to 3 mm was obtained by subsequent strand granulation.

TABLE 1

Compositions in parts by weight.

| | Ref. 1 | Ref. 2 | 1 | 2 | 3 | 4 |
|---|---|---|---|---|---|---|
| EVA[1] | 100.00 | | 39.85 | 39.85 | 23.00 | 33.20 |
| MAM-EVA[2] | | | 25.00 | 25.00 | 23.35 | 25.00 |
| Araldite ® GT 7071 (Huntsman) | | 98.07 | 6.00 | 6.00 | 6.00 | 6.00 |
| Escorez ™ 1304 (Exxon Mobil) | | | 15.00 | 15.00 | 10.00 | 10.00 |
| Chalk | | | 14.15 | 13.15 | 36.85 | 25.00 |
| Azodicarbonamide | | | | 1.00 | 0.80 | 0.8 |
| Dicyanodiamide | | 1.93 | | | | |

[1]EVA: Ethylene/vinyl acetate copolymer (vinyl acetate content 28% by weight, softening temperature (Ring & Ball Method according to DIN ISO 4625): 106° C.)
[2]MAM-EVA: Maleic acid anhydride-grafted ethylene/vinyl acetate copolymer (proportion of maleic acid anhydride: 0.27% by weight)

As a model for a roadway structure and for testing the mechanical values, in each case concrete plates that are 50×50×6 cm in size were coated with Sikafloor®-156 (primer, based on 2-component epoxide resin, available from Sika Schweiz AG) as a concrete primer in an amount of 0.3 to 0.4 kg/m$^2$. The primer was applied by means of a felt roller. After an air-out time of 12 hours, Sikalastic®-821 LV (2-component polyurethane composition) was sprayed mechanically by means of a 2-component high-pressure spraying unit, so that a plastic membrane formed. Then, after a waiting period of 2 hours, Sikafloor®-161 (available from Sika Schweiz AG) was applied as a plastic primer in an amount of 0.3 to 0.4 kg/m$^2$ by means of a felt roller. Then, in each case, granulates of the compositions according to Table 1 were scattered in an amount of 0.8 to 1.0 kg/m2 onto the still sticky plastic primer. After a waiting period of 24 hours, a roller asphalt AC T 16 N 70/100, heated to 160° C., was applied in two passes in an amount of 0.8 to 1.0 kg/m$^2$, so that in each case, a layer thickness of 4 cm was produced and rolled.

After cooling, after one day, the shear strength ("SF") was tested according to Standard EN-13653, and the rupture pattern obtained was visually evaluated. In all cases, a rupture either within the asphalt layer (near the interface) or in the boundary phase between the respective adhesive composition and the asphalt already showed. The thus obtained results are combined in Table 2.

TABLE 2

| Test results | | | | | | |
|---|---|---|---|---|---|---|
| | Ref. 1 | Ref. 2 | 1 | 2 | 3 | 4 |
| SF [N/mm$^2$] | 0.95 | 0.91 | 1.04 | 1.00 | 1.16 | 1.07 |
| Proportion of Cohesive Rupture[3] [%] | 0 | 10 | 82 | 88 | 100 | 100 |
| Proportion of Adhesive Rupture[4] [%] | 100 | 90 | 18 | 12 | 0 | 0 |

[3]Cohesive rupture within the asphalt

[4]Adhesive rupture between asphalt and granulate of the respective composition

The results show that the comparison examples Ref. 1 and Ref. 2 have a very high proportion of adhesive rupture, while the examples according to the disclosure have a very high proportion of cohesive rupture. The measured shear strength values of the examples according to the disclosure are noticeably to sometimes greatly increased relative to the comparison examples.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of Reference Numbers | |
|---|---|
| 1 | Roadway Structure |
| 2 | Support Structure, Concrete Support Structure |
| 3 | Primer, Concrete Primer |
| 4 | Plastic Membrane |
| 5 | Adhesive Composition |
| 5' | Adhesive Composition 5 in the Form of a Granulate |
| 5" | Adhesive Composition 5 in the Form of a Membrane |
| 5'" | Adhesive Composition 5 in the Form of a Dispersion |
| 6 | Plastic Primer |
| 7' | Adhesive Layer |

-continued

| List of Reference Numbers | |
|---|---|
| 7" | Interface Area, Modified with Adhesive Composition, of the Plastic Membrane 4 |
| 7'" | Interface Area, Modified with Adhesive Composition, of the Support Layer 8 |
| 8 | Bitumen-Based Support Layer |
| 9 | Pressure-Sensitive Adhesive |
| 10 | Separating Membrane |

What is claimed is:

1. A method for the production of a roadway structure, the method comprising:

(i) applying a primer to a support structure;

(ii) applying a plastic membrane to the support structure that is primed according to step (i); and then (iii) applying an adhesive composition that includes a) at least one solid epoxide resin, and b) at least one thermoplastic polymer that is solid at room temperature, and (iv) applying a bitumen-based support layer.

2. The method according to claim 1, wherein the adhesive composition further comprises a chemical or physical blowing agent.

3. The method according to claim 1, wherein the thermoplastic polymer that is solid at room temperature is an ethylene/vinyl acetate copolymer.

4. The method according to claim 1, wherein the adhesive composition is used in the form of a granulate.

5. The method according to claim 1, wherein the adhesive composition is used in the form of a membrane.

6. The method according to claim 1, wherein the bitumen-based support layer is applied directly to the adhesive composition.

7. The method according to claim 1, wherein the thermoplastic polymer that is solid at room temperature has a softening point in the range of 80° C. to 150° C.

8. The method according to claim 1, wherein the weight ratio of solid epoxide resin to thermoplastic polymer that is solid at room temperature is between 1:2 and 1:10.

9. The method according to claim 1, wherein the plastic membrane is a polyurethane membrane.

10. The method for the production of a roadway structure according to claim 1, wherein the bitumen-based support layer is applied directly to the applied adhesive composition.

11. The method according to claim 10, wherein the thermoplastic polymer that is solid at room temperature is an ethylene/vinyl acetate copolymer.

12. The method according to claim 10, wherein the adhesive composition further comprises a chemical or physical blowing agent.

13. A roadway structure, comprising:

a support structure, whose surface is coated with a primer, on which a plastic membrane is applied, a bitumen-based support layer, and (i) an adhesive layer located between the plastic membrane and the bitumen-based support layer, wherein the adhesive layer is formed from at least one solid epoxide resin and at least one thermoplastic polymer that is solid at room temperature; or (ii) a modified area of the plastic membrane and/or the bitumen-based support layer in an interface area between the plastic membrane and the bitumen-based support layer, wherein the modified area is modified with at least one solid epoxide resin and at least one thermoplastic polymer that is solid at room temperature; or (i) and (ii).

14. The roadway structure according to claim 13, wherein the thermoplastic polymer that is solid at room temperature is an ethylene/vinyl acetate copolymer.

15. The roadway structure according to claim 13, wherein the plastic membrane is a polyurethane membrane.

16. The method according to claim 1, wherein the primer is a concrete primer and the support structure is a concrete structure.

17. The method according to claim 1, wherein the thermoplastic polymer that is solid at room temperature has a softening point in the range of 90° C. to 130° C.

18. The method according to claim 1, wherein the weight ratio of solid epoxide resin to thermoplastic polymer that is solid at room temperature is between 1:4 and 1:8.

19. The method according to claim 1, wherein the plastic membrane is a sprayed two-component polyurethane membrane.

20. The roadway structure according to claim 13, wherein the plastic membrane is a sprayed membrane that includes two-component polyurethanes.

21. The roadway structure according to claim 13, wherein the roadway structure comprises only one of (i) and (ii).

* * * * *